US005782183A

United States Patent [19]

Andrews, Jr.

[11] Patent Number: 5,782,183

[45] Date of Patent: Jul. 21, 1998

[54] PRESSURIZED MACHINE FOR PROCESSING BLANKS

[75] Inventor: John H. P. Andrews, Jr., Monkton, Md.

[73] Assignee: Ward Holding Company, Inc., Wilmington, Del.

[21] Appl. No.: 812,591

[22] Filed: Mar. 7, 1997

[51] Int. Cl.[6] ..... B41F 13/24

[52] U.S. Cl. ..... 101/232; 101/233

[58] Field of Search ..... 101/232, 424.1, 101/233, 216; 400/635

[56] References Cited

U.S. PATENT DOCUMENTS

| | | | |
|---|---|---|---|
| 3,477,558 | 11/1969 | Fleischauer | 198/184 |
| 3,902,407 | 9/1975 | Trosdorff | 93/49 R |
| 3,904,188 | 9/1975 | Fairbanks et al. | 271/3 |
| 5,156,257 | 10/1992 | Hundebl | 198/689.1 |
| 5,163,891 | 11/1992 | Goldsborough et al. | 493/321 |
| 5,183,251 | 2/1993 | Sardella | 271/276 |
| 5,445,369 | 8/1995 | Golicz et al. | 271/3.23 |
| 5,509,352 | 4/1996 | Kowalewski et al. | 101/232 |
| 5,564,693 | 10/1996 | Elkis et al. | 271/276 |

*Primary Examiner*—Edgar S. Burr
*Assistant Examiner*—Anthony H. Nguyen
*Attorney, Agent, or Firm*—Bartlett & Sherer

[57] ABSTRACT

A machine is disclosed for printing and/or otherwise processing blanks of sheet material in which the interior of the machine is pressurized to a super-atmospheric pressure such that the blanks are forced firmly against the transfer conveyor between sections of the machine and dust in the ambient air is prevented from entering the machine and contaminating the print function.

17 Claims, 4 Drawing Sheets

PRESSURIZED MACHINE FOR PROCESSING BLANKS

FIELD OF THE INVENTION

This invention relates to machines for printing and otherwise processing paperboard and plastic blanks, and more particularly, to a sheet or blank processing machine which is internally pressurized.

BACKGROUND

Various types of processing machines are known for printing, die cutting, folding and otherwise processing blanks of plastic sheets or paperboard, such as corrugated board, for example, for making a wide variety of products such as displays, containers, and other printed products. Such processing machines include various sections or stations for performing each of the individual functions such as printing, die cutting, gluing, folding, etc. These sections are aligned in series along the horizontal length of the machine, and various types of transfer means are utilized to convey the blanks of sheet material between the different sections of the machine, including for example, between multiple sections of printing when performing multi-color printing on the blanks.

Because of the nature of paperboard and plastic sheets, and particularly in the case of blanks of corrugated paperboard, a large amount of tiny particles, generally referred to as "dust," is produced as thousands of board-feet per day of sheets or blanks are processed in a given day. This dust builds up within the machine, and also causes the surrounding ambient air to become dust-laden as well. As a result, the dust-laden air flows into and around the printing sections which can cause serious contamination of the printing function. In addition, the dust problem is further complicated by the fact that, whereas older processing machines used nip or feed rollers to convey the blanks between the various sections of the machine, the presently preferred practice is to use transfer conveyors between the sections including between the individual print sections. This substantially increases the dust contamination problem because conveyor belts require a high velocity of air flow in contact with the blanks in order to urge the blanks into firm contact with the belts. This high velocity air flow is typically created by various types of vacuum systems in which a suction blower or vacuum pump is mounted on the opposite side of the conveyor belts from the blanks, and air from within the machine is sucked against the opposite side of the blanks, thereby forcing them against the belts of the transfer conveyors. Then, the dust-laden air is typically exhausted into the surrounding atmosphere from which it may be drawn back into the machine. In other machines, ambient dust-laden air may be forced against the surfaces of the blanks, such as through a plurality of nozzles in order to urge the blanks into tight frictional engagement with the transfer conveyor belts. In any case, highly dust-laden air is drawn into the interior of the machine such as to cause serious consequences in the operation of the machine, such as for example, in the bearings and particularly in the printing sections by contaminating the ink rollers and the printed images produced thereby. In addition, vacuum systems generally require hoods through which the air is drawn, and the blanks are only effected by the air flow when they are within the area of the hoods. That is, the blanks are not controlled by any air flow when they are outside of the hooded areas.

SUMMARY

The present invention solves the above-indicated problems of dust contamination as well as providing improved control and adherence of the blanks to the transfer conveyors. This is accomplished by pressurizing the interior of the machine such that the air flow maintains the blanks in firm engagement with the transfer conveyors, and the super-atmospheric pressure within the machine prevents infiltration of the ambient, dust-laden air.

DETAILED DESCRIPTION

Figure 1:
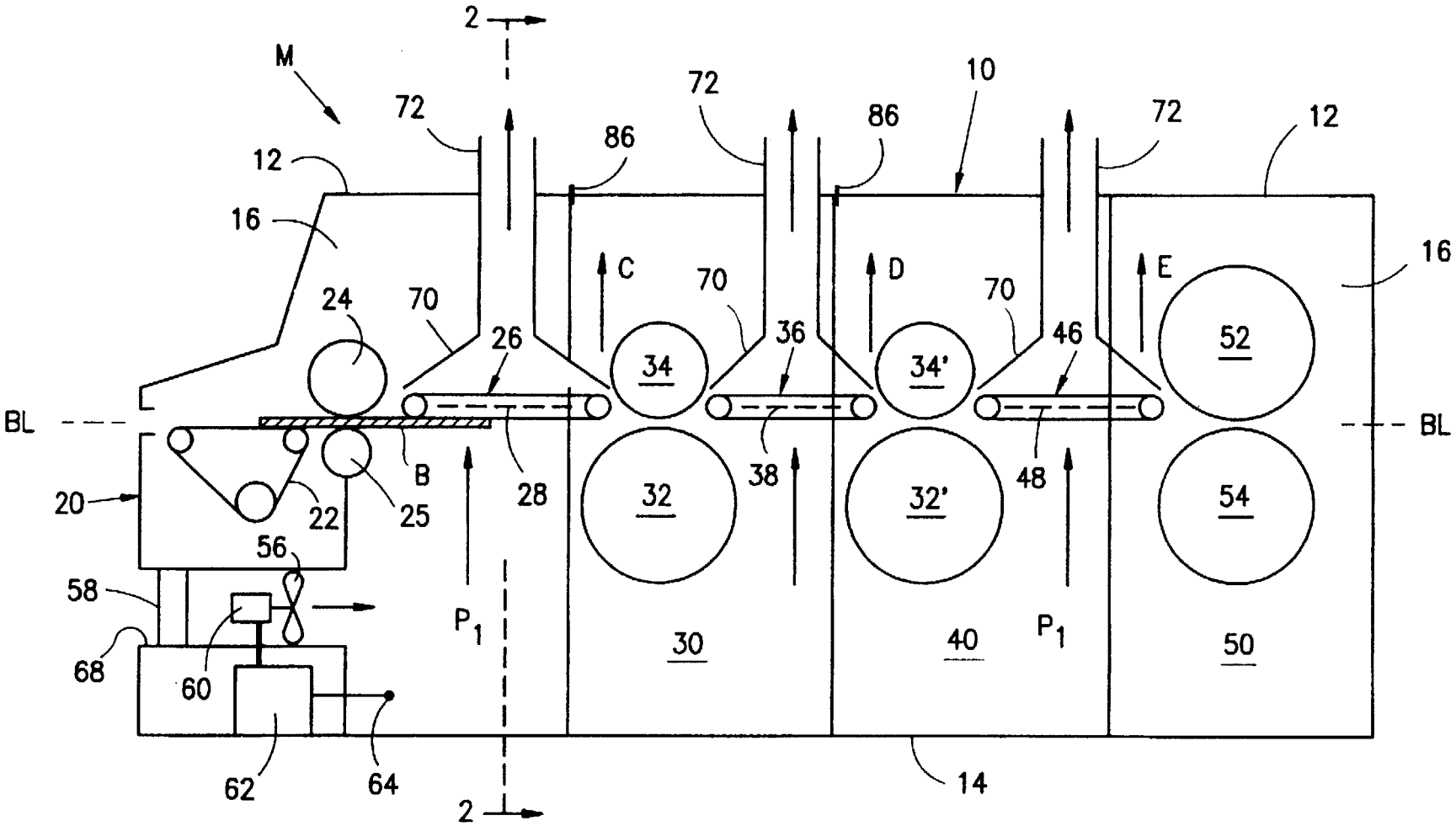
FIG. 1 is a schematic, side elevational view of the machine of the present invention.
Figure 2:
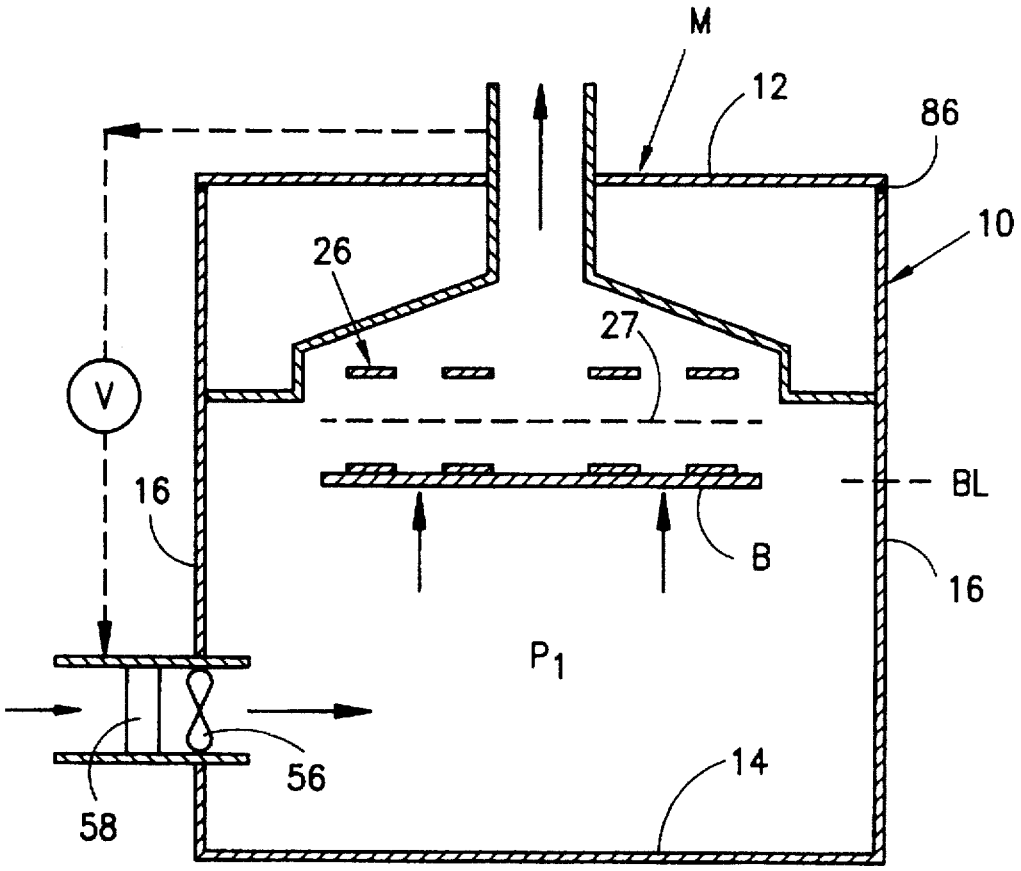
FIG. 2 is a schematic, cross-sectional view of the machine taken along view line 2—2.

Referring to FIGS. 1 and 2, the processing machine M comprises a horizontally elongated housing 10 including top walls 12, a bottom wall 14, and side walls 16. In lieu of a separate bottom wall 14, it will be understood that the bottom wall may be the floor under the machine, and that seals may be provided between the floor and the side walls 16. The elongated machine is built in sections or stations for performing various functions such as feeding, printing and die cutting, and the sections may be fixed or mounted on rails (not shown) for removal or separation of sections. It will also be readily understood to those skilled in the art that the overall processing machine may also include additional downstream sections for performing folding and gluing functions, and/or additional intermediate stations for slotting, slitting and drying which are not illustrated for the sake of clarity.

Feed section 20 schematically illustrates a feed mechanism 22 for conveying the blanks B from the feed end, at the left of FIG. 1, to the feed rolls 24 and 25. Such feeding mechanisms may comprise a feed belt as illustrated, or may take many other well-known forms, and the details thereof are not relevant to the present invention.

After passing through feed rolls 24 and 25, the blanks pass under the bottom reach of a transfer conveyor generally designated 26 which may be of any well-known construction. In the preferred embodiment, a flow-restrictive device such as perforated plate 28 is preferably located between the upper and lower reaches of the conveyor. However, it is to be understood that the restrictive device may comprise a layer of filter material, and that the restrictive device may be located above the upper reach of conveyor 26. The blanks B are conveyed in contact with the lower reach of the conveyor by a differential pressure as will be explained hereinafter, and the blanks are conveyed to a first print station 30 which generally comprises print cylinder 32 and impression cylinder 34. After exiting the first print station, the blanks may be conveyed to the bottom reach of a second transfer conveyor 36 which preferably includes a flow restriction device, such as illustrated perforated plate 38, or other form of air flow restrictor. Thereafter, the blanks may be conveyed to other sections of the processing machine, such as a second print section 40, or directly to a die cut section 50, depending on the number of colors to be printed. Section 50 generally includes a die cutting cylinder 52 and an anvil roll 54. Die cutting cylinder 52 scores or cuts the blanks to form tabs, flaps or particular shapes of the blanks. Of course, the processing machine of the present invention may include as many or as few print sections as desired, and may or may not include a die cut section, and/or it may include such other sections as may be desired to perform desired processing functions on the blanks.

In order to hold the blanks firmly against the lower reach of transfer conveyors 26, 36 and 46, blank processing machines of the prior art have utilized vacuum-type systems such as, for example, locating a fan or blower above the transfer conveyors so as to draw air from below the blanks upwardly against the bottom surfaces of the blanks. However, as previously stated, vacuum-type systems create a sub-atmospheric pressure inside the machine housing, and this draws dust-laden ambient air into the machine which is highly detrimental for the reasons explained above.

Figure 3:
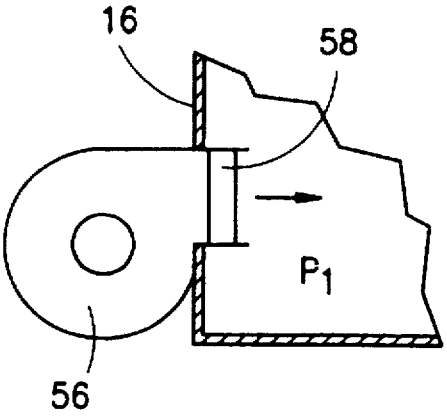
FIGS. 3 and 4 are schematic, fragmentary views of the bottom left corner of the machine shown in FIG. 2.
Figure 4:
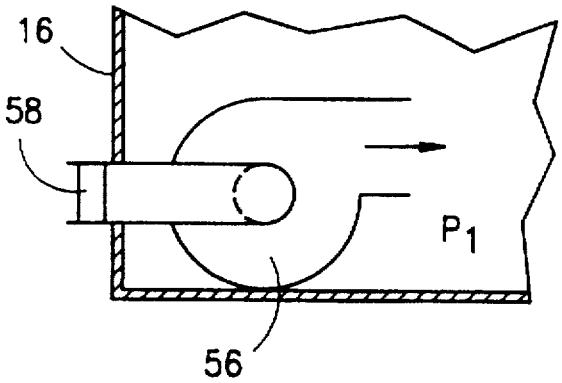
Figure 5:
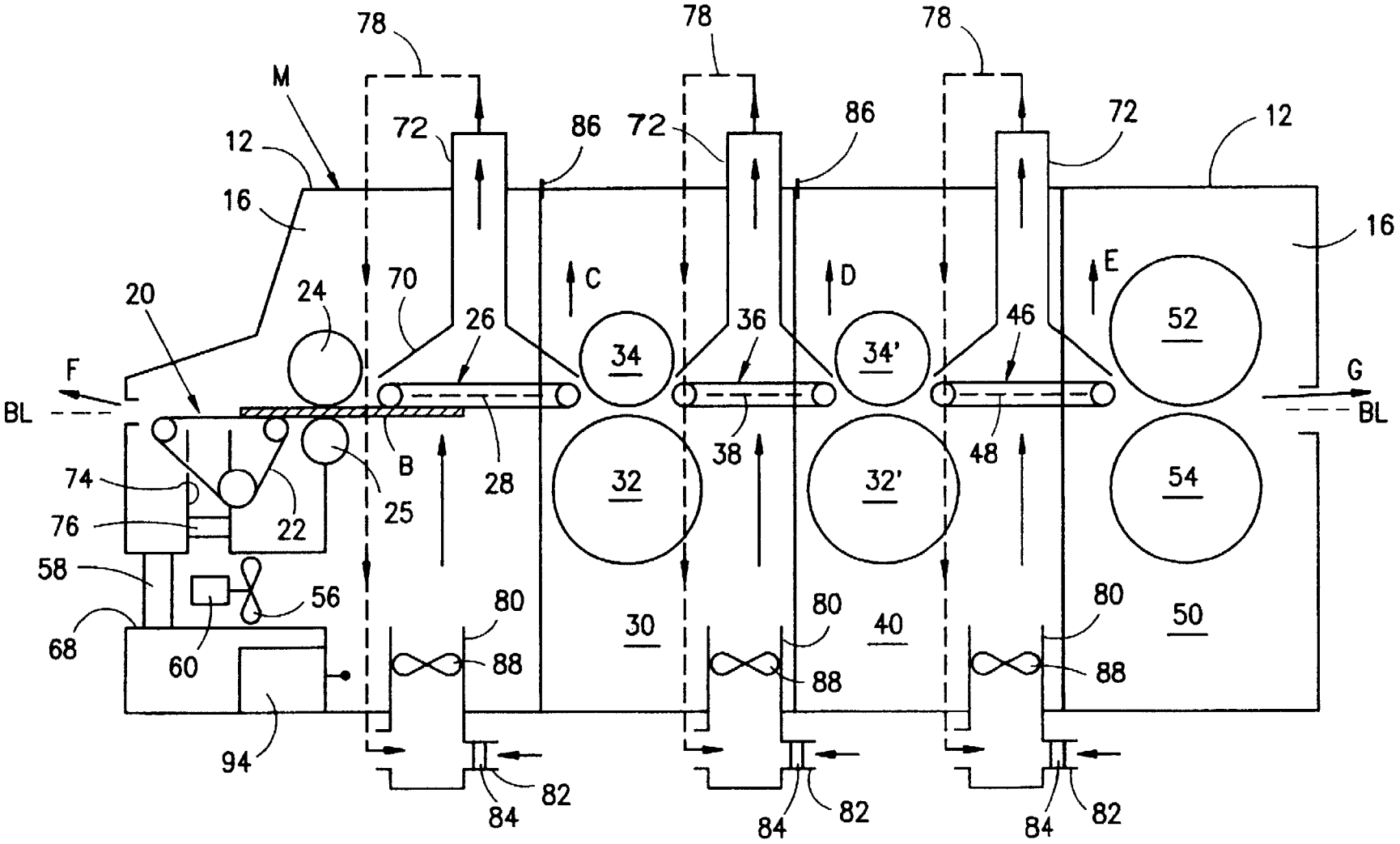
FIGS. 5 and 6 are schematic, side elevational views showing alternate embodiments of the machine of the present invention.

The present invention radically departs from this prior art practice and provides a pressurizing fan or blower 56, hereinafter generically referred to as a blower, which draws air through a dust removal filter 58 into the interior of housing 10. Blower 56 is preferably operated by a motor 60 and controls 62, including a pressure sensor 64, so as to create and maintain a super-atmospheric pressure $P_1$ throughout the interior of the machine, and particularly below the line of travel of the blanks B indicated as board line BL. In FIG. 1, blower 56 and filter 58 are schematically illustrated as being positioned in a duct 68 extending through the feed section of the machine; however, it will be readily apparent that they may be positioned elsewhere in the machine such as, for example, at multiple positions in the side or bottom walls as schematically illustrated in FIGS. 2 and 5. Also, as schematically illustrated in FIGS. 3 and 4, it will be apparent that the physical location of the filters and blower(s) per se may be outside of, or inside of, the housing 10 of the machine so long as the inlet and discharge are directed so as to discharge the filtered air into the interior of the machine and thereby produce a super-atmospheric pressure $P_1$ of filtered, relatively clean air within the machine.

As shown most clearly in FIGS. 1 and 2, the filtered air at super-atmospheric pressure flows upwardly against the bottom surfaces of blanks B and through conveyors 26, 36 and 46, thereby securely holding the blanks against the bottom reach of the conveyors. Flow restrictors 28, 38 and 48 produce a significant pressure drop as the air passes through the restricted holes or filter material such that the pressure below below these restrictors is at super-atmospheric pressure $P_1$ and the pressure above the restrictors is substantially less. Thus, the flow restrictors substantially decrease the volume of air flow when blanks are not being conveyed, and significantly reduce the air flow between blanks when they are being conveyed in spaced series along the board line BL. This reduces the overall mass flow and substantially reduces the power requirements. For additional efficiency, hoods 70 may be employed to smoothly conduct the air flow upwardly through exit ducts 72, either to the surrounding atmosphere, or through recycle lines as will be more fully explained hereinafter. In this manner, the uncontrolled entrance of dust-laden atmospheric air into the machine is prevented, and only fresh-filtered and/or recycle-filtered air is permitted to enter the interior of the machine.

In addition to not drawing dust-laden air into the machine, the previous leakage of air through section joints, panels and other housing members is actually reversed such that only clean, filtered air flows through these openings, and it flows outwardly so as to prevent the ingress of dust-laden ambient air. Thus, the environment surrounding the print cylinders is maintained with clean, filtered air so as to avoid dust contamination and its serious consequences as previously described. Also, the air flowing around hoods 70, such as leakage air illustrated by arrows C, D and E, also acts against the blanks and forces them upwardly against the conveyors. That is, air slow outside of the areas of hoods 70 also assists in controlling the blanks as they move through the machine.

In addition to providing super-atmospheric pressure to exclude the entrance of dust-laden air, the preferred embodiment of the present invention provides for the recycle of pre-filtered air so as to minimize the amount of air to be filtered. As schematically shown in FIG. 5, air from the feed end may be drawn through an internal duct 74 including a filter 76 to mix with ambient air coming in through duct 68 and filter 58. Alternatively, both air streams may join and then flow through a single filter in duct 68. In addition, all or part of the air exiting ducts 72 may be recycled through lines 78 back into the machine through ducts 80 and recycle blowers 88 such that only such make-up air from ambient as is required to compensate for losses need be added through ducts 82 including filters 84. Such recycle substantially reduces the power requirements for recirculating and filtering the total air flow such that significant economy can be achieved.

For the preferred embodiment of the invention, blower 56 is sized so as to provide the necessary internal pressure as well as accounting for unavoidable losses through the feed end as illustrated by flow arrow F, and as well as losses through the discharge end illustrated by flow arrow G. Each of recycle blowers 88 is sized so as to account for unavoidable losses from the corresponding section of the machine as illustrated by flow arrows C, D and E. In this manner, various individual sections of the machine, such as the number of print sections, for example, may be added or removed as required while still maintaining the pressure balance in each section and the desired super-atmospheric pressure through the machine, and particularly below the board line.

Figure 6:
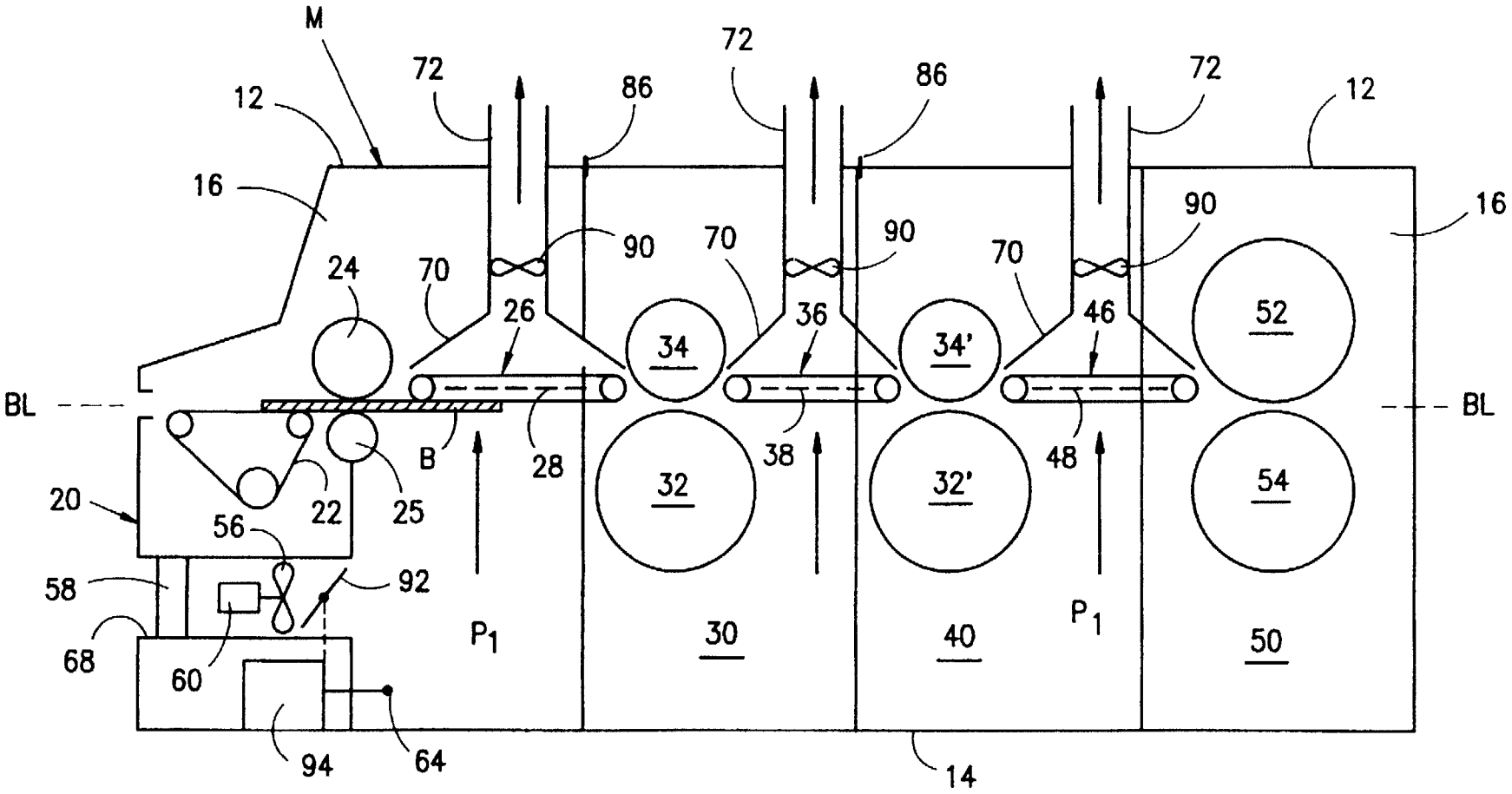

In the description of the foregoing preferred embodiments, it has been assumed that the entire mass-flow of the air through the machine is a result of the super-atmospheric pressure $P_1$ produced by one or more of blowers 56. However, as schematically illustrated in FIG. 6, the mass flow may be augmented by the provision of additional fans or blowers 90, hereinafter referred to generally as blowers. In this manner, blowers 90 assist in drawing the air out of the upper portions of the machine; ie, the portions above the board line and restrictors 28, 38 and 48, and thereby assist in maintaining the pressure differential across the blanks. In addition, it will be apparent that some or all of the flow out of exit ducts 72 may be recycled back into the machine as previously described with respect to FIG. 5.

Lastly, it will be understood that the efficiency of the present invention may be further improved by the provision of air sealing means, such as gaskets 86, between the various sections, tops and side walls of the machine, and variable speed motors may be employed to drive the blower(s) at variable speeds so as to maintain $P_1$ at any desired pressure as sensed by sensor 64 and controlled by motor controller 62. Alternatively, a relatively constant positive pressure $P_1$ may be maintained by the provision of dampers, such as damper 92 in FIG. 6, which regulates the flow of ambient air into the machine such as by a controller 94. It will also be apparent that while the illustrated embodiments show the blanks as being below the conveyors, the present invention includes pressurizing the top portion of the machine; ie, the portion bove the board line for those machines in which the blanks are conveyed on the top side of the conveyor. Thus, it will be apparent that numerous changes and variations may be made in the illustrated embodiments, which are shown as being illustrative rather than exhaustive of the principles of the present invention, and it is to be understood that the present invention is not intended to be limited other than as expressly set forth in the following claims.

What is claimed is:

1. A machine for printing and otherwise processing blanks of sheet material comprising:

(a) means forming a printing section;

(b) means forming a processing section;

(c) housing means surrounding said printing and process sect ions;

(d) conveyor belt means having a lower reach for horizontally conveying said blanks from said printing section to said processing section within said housing means;

(e) exhaust duct means positioned above said conveyor belt means for exhausting air from the interior of said housing means;

(f) flow-restricting means positioned above said lower reach of said conveyor means for restricting the air flow passing therethrough and creating a pressure drop thereacross;

(g) blower means for forcing air into said machine and creating a super-atmospheric pressure throughout the interior of said housing below said flow-restricting means; and (h) filter means for removing dust from said air forced into the interior of said housing whereby said blanks are forced upwardly against said lower reach of said conveyor belt means as said super-atmospheric air flows against said blanks and then through said flow-restricting means toward said exhaust duct means.

2. The printing and processing machine of claim 1 wherein said processing section includes means for printing on said blanks in a second printing section.

3. The printing and processing machine of claim 1 wherein said flow-restricting means comprises porous filter material.

4. The printing and processing machine of claim 1 including recycle means for recycling air from said exhaust duct means back to the interior of said housing means.

5. The printing and processing machine of claim 4 wherein said recycle means include filter means for filtering dust from make-up air from ambient.

6. The printing and processing machine of claim 4 including recycle blowers positioned in said exhaust duct means.

7. A machine for processing corrugated blanks with substantially reduced contamination by ambient air and controlling said blanks within said machine comprising:

(a) means forming a horizontally extending elongated housing;

(b) first and second processing sections positioned in said housing;

(c) transfer means for transferring said blanks horizontally along a board line from said first processing section to said second processing section;

(d) flow-restricting means extending horizontally above said board line for producing a pressure drop above said board line; and (e) blower means having an outlet connected to the interior of said housing for maintaining a super-atmospheric pressure throughout said housing below said board line for preventing the entrance of ambient air therein and for urging said blanks against said transfer means.

8. The machine for processing blanks of claim 7 including filter means for filtering said ambient air prior to entry into said interior of said machine.

9. The machine for processing blanks of claim 7 wherein said transfer means comprise upper and lower reaches, and said flow-restricting means extend horizontally between said upper and lower reaches.

10. A machine for processing blanks of sheet material comprising:

(a) means forming a housing;

(b) first and second processing sections located within said housing and spaced apart horizontally from each other;

(c) conveyor means for transferring said blanks from said first processing section to said second processing section;

(d) flow-restricting means adjacent said conveyor means; and (e) blower means having an inlet and an outlet, said inlet being connected directly to ambient air exterior of said housing, said outlet being connected to the interior of said housing, and said blower means being of sufficient size and flow capacity for creating and maintaining a substantial super-atmospheric pressure throughout the interior of said housing below said flow-restricting means.

11. The machine of claim 10 including dust removal means, said dust removal means being positioned such as to remove dust from the air before the air is discharged by said blower means into the interior of said machine at super-atmospheric pressure.

12. The machine of claim 10 wherein said blower means comprise a plurality of individual blowers having inlets directly connected to ambient air and outlets discharging directly into said first and second processing sections.

13. The machine of claim 10 including exhaust duct means positioned above said conveyor means such that said blanks are urged upwardly against said conveyor means by air at super-atmospheric pressure flowing toward said exhaust duct.

14. The machine of claim 13 including additional blower means located in said exhaust duct means for assisting the flow of air therethrough.

15. The machine of claim 10 wherein at least one of said first and second processing sections includes printing means for printing on said blanks.

16. The machine of claim 10 including at least one recycle duct in one of said first and second processing sections for recycling air from one location in the interior of said housing to another location in the interior of said housing.

17. The machine of claim 15 including at least one recycle duct in one of said first and second processing sections for recycling air from one location in the interior of said housing to another location in the interior of said housing.

* * * * *